US005493744A

United States Patent [19]

Beckstein et al.

[11] Patent Number: 5,493,744

[45] Date of Patent: Feb. 27, 1996

[54] METHOD FOR WASHING A TEXTILE WIDTH OF FABRIC AND CORRESPONDING FULL-WIDTH WASHING MACHINE

[75] Inventors: Helmut Beckstein, Bad Abbach, Germany; Hans Bors, Zürich, Switzerland; Bernhard Brendel, Mülhausen, Germany

[73] Assignee: Eduard Kusters Maschinenfabrik GmbH & Co KG, Germany

[21] Appl. No.: 313,272

[22] PCT Filed: Apr. 1, 1993

[86] PCT No.: PCT/DE93/00306

§ 371 Date: Oct. 31, 1994

§ 102(e) Date: Oct. 31, 1994

[87] PCT Pub. No.: WO93/20276

PCT Pub. Date: Oct. 14, 1993

[30] Foreign Application Priority Data

Apr. 2, 1992 [DE] Germany ..... 42 11 055.6

[51] Int. Cl.[6] ..... D06B 5/08

[52] U.S. Cl. ..... 8/149.3; 8/158; 68/5 D; 68/6

[58] Field of Search ..... 8/149.1, 149.3, 8/158; 68/5 A, 5 D, 6; 15/345, 306.1, 309.1

[56] References Cited

U.S. PATENT DOCUMENTS

| | | | |
|---|---|---|---|
| 1,375,663 | 4/1921 | Ainsworth | 15/309.1 X |
| 2,008,230 | 7/1935 | Spooner | 68/5 D |
| 3,732,072 | 5/1973 | Bahnsen | 8/149.1 |
| 3,811,834 | 5/1974 | Schwemmer et al. | 8/158 X |
| 4,231,129 | 11/1980 | Winch | 8/149.3 X |

FOREIGN PATENT DOCUMENTS

| | | | |
|---|---|---|---|
| 2001699 | 9/1969 | France . | |
| 2059308 | 1/1972 | Germany . | |
| 2814196 | 10/1979 | Germany . | |
| 3103359 | 8/1982 | Germany . | |
| 3229004 | 2/1984 | Germany . | |
| 2114917 | 9/1983 | United Kingdom | 8/158 |
| 93/05225 | 3/1993 | WIPO . | |

*Primary Examiner*—Philip R. Coe
*Attorney, Agent, or Firm*—Kenyon & Kenyon

[57] ABSTRACT

In a full-width washing machine for a steam-permeable textile width of fabric, an injection device for steam is provided on one side the width of fabric, and on the other side, opposite this device, a suction device is provided, which can generate a partial vacuum of at least 0.2 bar. The exit opening of the injection device and the entry opening of the suction device extend over the entire width of the width of fabric. The width of fabric is guided through and between the injection device and the suction device. Steam is injected into the width of fabric and driven through the width of fabric and extracted on the other side, together with the residues which have been dissolved out of the fabric.

19 Claims, 2 Drawing Sheets

METHOD FOR WASHING A TEXTILE WIDTH OF FABRIC AND CORRESPONDING FULL-WIDTH WASHING MACHINE

BACKGROUND OF THE INVENTION

1. Field of the Invention

The invention relates to a method for washing a textile width of fabric and a full-width washing apparatus for performing the method.

2. Discussion of the Prior Art

Full-width washing machines for textile widths of fabric are known in various versions. A significant problem, in many cases, consists of the fact that residues from the usual pretreatment and wet refining stages (desizing, washing out preparations, dyeing, printing, finishing) remain behind inside the width of fabric. In the case of very heavy or very dense widths of fabric, in particular, the expenditure of energy and washing water can become substantial with known washing methods, if sufficient removal of residues is to be achieved.

German Publication DE 20 59 308 A1 describes a method, as described above, and an arrangement for rinsing washing liquid out of textile articles, where steam from a rinsing unit, mixed with entrained water, is blown onto the width of fabric, which fabric is guided horizontally between screen bands. The steam and entrained water is blown from a slit nozzle which extends laterally across the width of the fabric. At a slight distance beneath the last screen band, a catch device equipped with an entry opening is arranged below the slit nozzle. The liquid which has passed through the width of fabric and is charged with the residues can be captured without pressure by the catch, and is pumped back into the rinsing unit.

Tests have shown that the washing effects which can be achieved with such an arrangement do not exceed those of conventional washing units to any significant extent.

German Publication DE 31 03 359 A1 shows that a device for uniform application of a small amount of a treatment agent, in the form of a foam, to the surface of a width of material is known. The foam first is applied from a foam application device to a screen band which runs along with the material. The screen band then comes into contact with the material, and part of the foam is transferred to the material as a result of the contact. The material and the screen band then pass through a pair of squeezer rollers. In order to enhance the transfer of foam, a suction nozzle can be provided after the pair of squeezer rollers, on the back of the width of material. The effect of the suction nozzle may be enhanced by a blower nozzle located opposite the suction nozzle, above the width of material. This publication involves application and uniform distribution of a substance on the width of material, which substance is intended to remain on or in the material. The substance described in this publication is not supposed to be decomposed or split and removed from the material.

SUMMARY OF THE INVENTION

The present invention achieves washing effects which are an improvement over prior art methods and apparatuses.

An essential point of the present invention lies in the fact that steam is injected into the width of fabric on one side and drawn out on the other side, in the vicinity of the injection region. The steam, together with the residues that have remained in the width of fabric are drawn out, under the effect of a powerful partial vacuum. It has been shown that blowing the steam on the fabric at significant excess pressure (i.e., pressure above atmospheric), while drawing it off from the other side, practically simultaneously, at a partial vacuum of at least 0.2 bar, results in a significant improvement of the washing effect. The partial vacuum not only suffices to transport off the medium which passes through the width of fabric, but also results in a strong flow through the fabric, so that the residues, which have just been hit by the steam blown onto them, are practically torn out of the fabric. This makes more effective washing possible, in relatively simple manner (if necessary, in addition to conventional washing processes). The energy expenditure remains within limits, since the steam, i.e. its condensate, is essentially removed entirely and can remain in circulation. Depending on the steam setting, a damp width of fabric can leave the full-width washing machine at a slightly lower moisture, a dry width of fabric can leave the full-width washing machine at only slightly increased moisture, so that the heat content of the fabric remains essentially unchanged and not much heat is transported out of the apparatus using this process.

The expression "in the vicinity" as used herein in relation to the opposite positions of the exit opening and the entry opening means that application of the steam on the one side of the width of fabric and drawing it off from the other side takes place not at any great distance from one another in the transport direction and with a corresponding time interval, but rather takes place in one pass. Even though it is not compulsory that the exit opening and the entry opening are exactly opposite each other, and also not that both of them be pressed down on the width of fabric with their delimitations (even though this is the preferred embodiment), any gaps between the openings, i.e. their delimitations in the transport direction of the width of fabric and perpendicular to the fabric surface, should be on the order of the expanse of the openings in the transport direction—in other words should be, in practice, on the order of millimeters or, at most, a few centimeters. This close "vicinity" makes it possible to maintain the pressures on the pressure side and the suction side which are necessary to achieve the washing effect, without having to use over-size pressure and suction pumps.

By means of the steam impact, thermal and mechanical energy is applied to the width of fabric, i.e. the residues located on it. In many instances, the residues consist of organic treatment agents or processing aids or include such agents, which have significant molecule sizes. The theory of the present invention is that these large molecules are excited to decomposition or splitting by the energy applied, and removed from the width of fabric in this more mobile state, by being drawn off "in the vicinity," before they can come together into larger and less mobile units again.

Pressure and suction devices arranged directly opposite one another on both sides of the width of fabric are known, as such, from DE 31 03 359 C 2, but here the medium moved through the width of fabric is not steam but foam, and the process in question is not washing, but rather application of a treatment agent onto the width of fabric.

It has been shown that the washing effect is further improved if the excess pressure on the steam injection side and/or the partial vacuum on the suction side are each at least 0.5 bar.

Various versions of the exit and entry openings are possible within the scope of the invention.

An important characteristic is the adjustability of the openings, because this makes an adaptation to different fabrics possible. In order to achieve the optimum washing effect, it is understandable that the structure and arrangement of the openings must be different, for example for a thin, loosely woven fabric, a densely compacted heavy fabric, a pile fabric, and especially carpeting.

The adjustability is particularly advantageous in combination with a control and regulation device, which allows regulation of the washing process as a function of fabric-specific parameters, which means it can be set automatically.

The control and regulation device can comprise several regulators assigned to the individual components of the machine; preferably, however, the essential control and regulation elements, or all of them, are brought together in a central control and regulation unit.

The control and regulation can particularly involve the flow amount and/or the flow pressure, as well as the expanse of the openings in the flow direction, i.e. the width of the slit nozzles.

An important influencing factor for the washing process is the transport speed of the width of fabric, which can be included in the control and regulation.

A particular regulating factor which is characteristic for the washing effectiveness is the concentration of the residues washed out of the width of fabric in the control and the medium drawn off. This can be included in regulation.

Alternatively, the concentration of the residues remaining on the width of fabric can also be determined, and the corresponding concentration value can used for control and regulation.

Depending on the residues to be washed out, and the particular characteristics of the width of fabric in question, it can be practical to inject a gas, e.g., air, and/or a liquid, e.g. water into the width of fabric, in addition to the steam, and to draw this off again with the steam, on the other side.

BRIEF DESCRIPTION OF THE DRAWINGS

The drawing indicates embodiments of the invention in schematic form:

In FIGS. 1 to 3, a textile width of fabric 1 is indicated, which is transported horizontally in spread-out position, and has a certain permeability, so that steam blown onto the width of fabric 1 can pass through the width of fabric 1.

Figure 1:
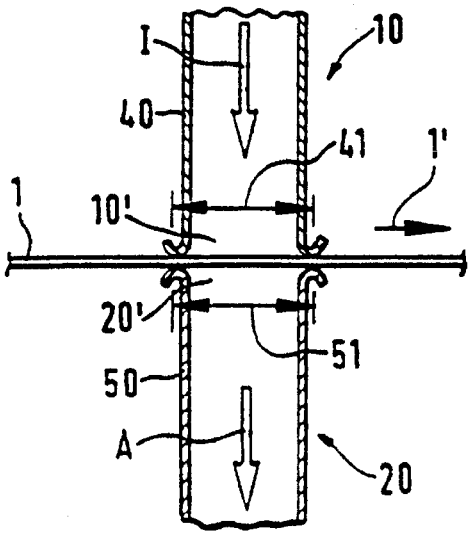
FIGS. 1 to 3 show possible arrangements of the exit and entry openings.

In the embodiment pursuant to FIG. 1, an injection device 10 is provided above the width of fabric 1, with an exit opening 10' which runs over the width of the fabric, in other words perpendicular to the plane of the drawing. The exit opening 10' is delimited by a slit nozzle 40, the expanse of which is adjustable in the transport direction 1' of the width of fabric 1, i.e., the slit width 41 is adjustable. A possible range for the slit width 41 is approximately 1 to 2 mm.

Below the width of fabric 1, in the embodiment pursuant to FIG. 1, a suction device 20 with an entry opening 20' is provided, which is formed by a slit nozzle 50 with an adjustable nozzle width 51. The expanse of the exit openings of the slit nozzles 40, 50 in the width direction of the fabric can be adjusted depending to the width of the fabric 1, so that no losses of steam or suction action occur.

In the embodiment of FIG. 1, the slit widths 41 and 51 are the same and the slit nozzles 40, 50 lie directly opposite one another. The exit edges of the slit nozzles 40, 50 rest against the width of fabric 1 on both sides, under slight pressure.

In the injection device 10, steam is blown onto and into the width of fabric 1 on its top side, under an excess pressure (i.e., pressure above atmospheric) of at least 0.2 bar, preferably even somewhat higher, e.g. in the range of 0.5 bar above atmospheric, as indicated by the arrow I. On the opposite side, i.e. the bottom in FIG. 1, the medium which passes through the width of fabric 1, i.e. a mixture of steam, water and residues dissolved out of the width of fabric 1, is drawn off at a partial vacuum of at least 0.2 bar, preferably around 0.5 bar, below atmospheric, as symbolized by the arrow A.

Figure 2:
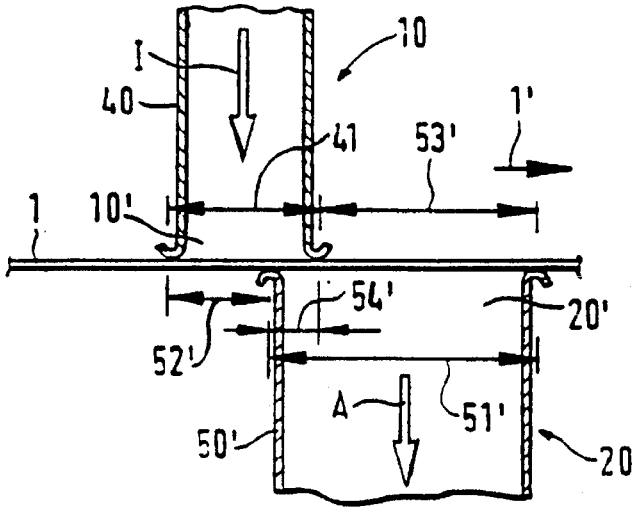

In the embodiment pursuant to FIG. 2, the slit nozzle 40 corresponds to that of FIG. 1. The width of fabric 1 lies against the nozzle edges. The slit nozzle 50' of the suction device 20, however, has approximately twice the width 51' of the slit nozzle 40, and is offset in the transport direction 1' by a stretch 52' with its trailing delimitation. The stretch 52' is smaller than the width 41 of the slit nozzle 40, so that the slit nozzle 50' is still partially located below the slit nozzle 40 in the region 54', but extends beyond it in its expanse in the transport direction 1'. As a result, air is also drawn through the width of fabric 1 from the outside space, in addition to the steam remaining in the width of fabric, the condensate formed there, and the residues to be removed. In the region 52', there is no nozzle opposite the exit opening 10', but the amount of steam that passes through the width of fabric 1 into the outside space in region 52 is relatively slight, since the steam blown on immediately condenses on and in the fabric, particularly in the first phase, and predominantly remains in it until it reaches the slit nozzle 50'.

Figure 3:
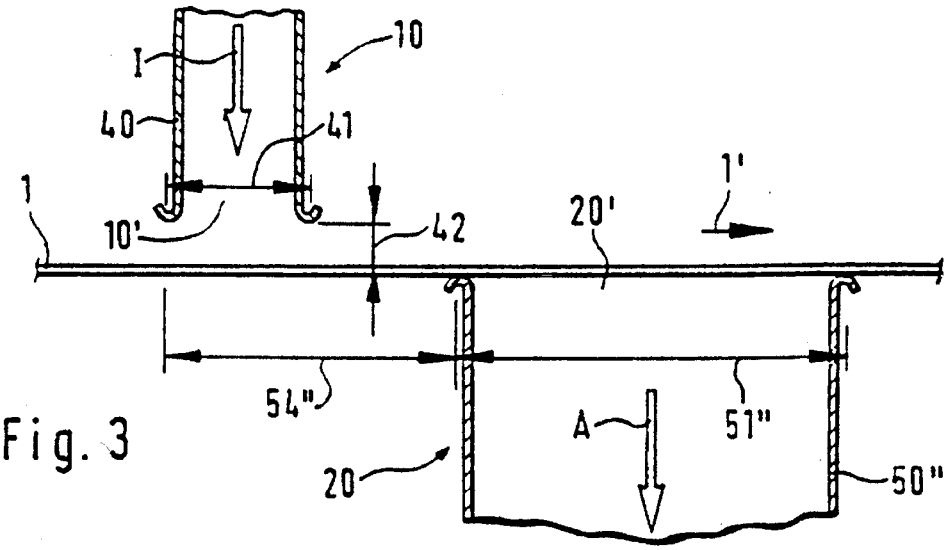

In the embodiment pursuant to FIG. 3, the slit nozzle 50" of the suction device 20 is approximately three times as wide as the slit nozzle 40 of the injection device 10 and is offset relative to the latter by a stretch 52" in the transport direction 1', with its trailing edge, which stretch 54 is greater than the width 41 of the slit nozzle 40. In other words, there is no longer any overlap of the slit nozzles 40 and 50".

Furthermore, the embodiment of FIG. 3 differs from the two preceding embodiments in that the edges of the slit nozzle 41 are located somewhat above the width of fabric, i.e. to maintain a certain distance from the width of fabric 1 perpendicular to its surface. Part of the steam blown on fabric 1 in the direction of the arrow I will therefore flow out sideways, parallel to the width of fabric, and partially condense on it, to be pulled into and through the width of fabric 1 by the partial vacuum which prevails above the slit nozzle 50", if it reaches there, in the direction of the arrow A. The width of fabric 1 will always rest against the edges of the slit nozzles 50, 50', 50", however in the embodiments of FIGS. 1–3, because it is drawn in by the partial vacuum that prevails there.

The exit opening 10' and the entry opening 20', however, should always stay in the vicinity of each other, which means that the two should not be removed from each other by more than the order of a slit nozzle width. Both the offset amounts 54' and 54" and the distance amount 42 should therefore amount to only a few millimeters or centimeters. It is therefore not intended to carry out injection of the steam in the direction of the arrow I at one location, and suction in the direction of the arrow A at another location, for example one meter apart. Instead, the steam is to be applied and injected into the width of fabric 1 and be drawn off again immediately or practically immediately.

Figure 4:
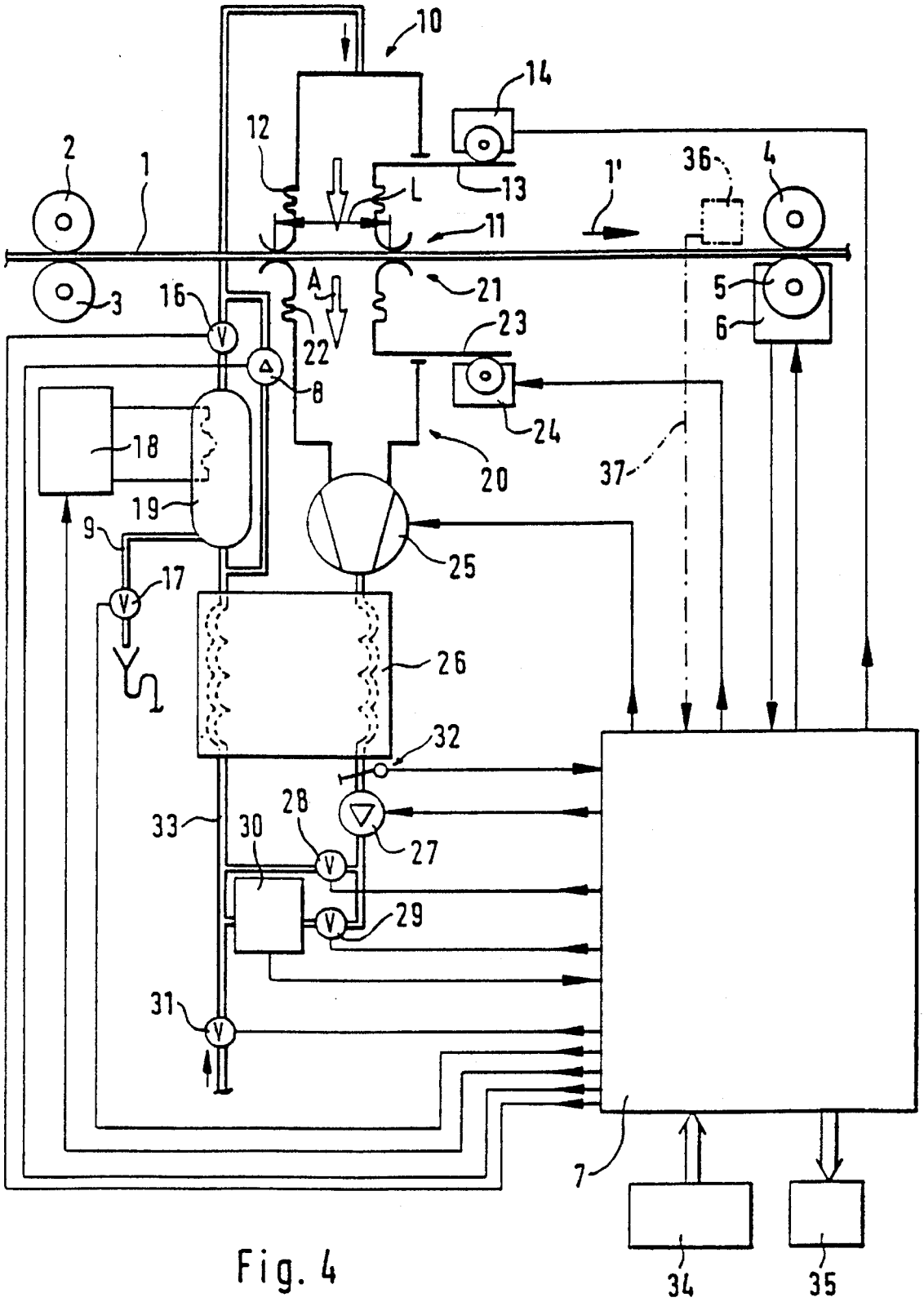
FIG. 4 shows a wiring diagram of a special embodiment of a full-width washing machine according to the invention.

The embodiment of FIG. 4 corresponds to the embodiment pursuant to FIG. 1 in terms of the structure and arrangement of the exit opening 10' and the entry opening 20'. The width of fabric 1 is drawn through and between the injection device 10 and the suction device 20 via guide rollers 2 to 5, with at least the guide roller 5 being driven by a drive motor 6. The injection device 10 and the suction device 20 have an injection slit nozzle 11 and a suction slit nozzle 21, respectively, which are pressed against one another by means of pressing devices 12 and 22, respectively, with the width of fabric 1 lying between them. In this way, the interior of the injection device is connected with the interior of the suction device 20, separated only by the width of fabric 1. The interiors are essentially sealed from the outside in this embodiment.

The injection slit nozzle 11 and the suction slit nozzle 21 each have an adjustment slide 13, 23, which is adjustable via an adjustment motor 14, 24. Adjustment takes place in such a way that the expanse of the slit nozzles 11, 21 in the transport direction 1', in other words the length L over which the width of fabric 1 is clamped between the edgings of the slit nozzles 11 and 21, can be adjusted and adapted, if needed. The length of the slit nozzles 11, 21, their expanse perpendicular to the transport direction 1' of the width of fabric 1 (in other words perpendicular to the plane of the drawing) is adapted to the width of the fabric 1. For this purpose, the slit nozzles 11, 21 can use elements which are inserted inside each other and can be moved relative to one another, in telescopic fashion.

The interior of the suction device 20 is connected with the suction side of a suction pump 25, which draws off the mixture which has passed through the width of fabric 1, condenses it, and passes it to a heat exchanger/condenser 26. The condensate, which comes from the heat exchanger 26 in cooled form with the residues, which have been removed from the width of fabric 1, contained in it is passed to a washing medium inlet line 33 by a condensate pump 27. The flow amount of the washing medium in the inlet line 33 is scanned by a flow sensor 32, the output signal of which is passed to a regulation device 7 which may be, e.g., a microprocessor.

Furthermore, the pressure-side exit of the condensate pump 27 is connected with a test device 30 via a test flow valve 29, which device generates output signals which reflect the state of contamination of the condensate, i.e. its concentration of absorbed residues. The condensate studied is passed to the inlet line again in the embodiment shown here, but it can also be discarded, since the amount of liquid required for the test is slight. The feed-back valve 28 and the test flow valve 29 are controlled by the central control and regulation unit 7.

The inlet line 33 is connected with a fresh water supply via a fresh water valve 31 controlled by the central control and regulation unit 7, and passes through the heat exchanger 26, so that recycled condensate mixed with fresh water can be heated in the heat exchanger 26.

The preheated liquid which comes from the heat exchanger 26 is passed to a steam generator 19, which can be heated by means of a heating unit 18 controlled by the central control and regulation unit 7. A waste water line 9 is provided for the steam generator 19, via which waste water can be drained from the steam generator 19 via a valve 17 controlled by the central control and regulation unit 7. This makes it possible to carry out condensation of the recycled condensate in the steam generator 19, and to keep the condensate at a uniformly high concentration of residues in the steam generator, so that the amounts of waste water drained are slight, i.e. the residues removed from the width of fabric 1 occur in a high concentration in the waste water.

The steam generator 19 delivers steam to the injection device 10 via a steam regulation valve 16 controlled by the central control and regulation unit 7. Furthermore, a pump 8 controlled by the central control and regulation unit 7 is provided, in order to mix recycled condensate into the steam directly behind the valve, circumventing the steam generator 19. If necessary, another washing liquid or fresh water can also be mixed in here. In this manner, the steam can be controlled in terms of its degree of saturation. Here again, mixing is controlled by the central control and regulation unit 7. Furthermore, it is provided to mix a gas, particularly air, in with the steam. This is particularly advantageous if large flow amounts per time unit are necessary due to the conditions which prevail at the width of fabric 1.

Here, the central control and regulation unit 7 functions in such a way that the entire washing process is controlled and regulated in accordance with fabric-specific data, which can be input via an input device 34, and treatment-specific data, such as the transport speed. Monitoring of the washing process in accordance with the output signals of the test device 30 is conducted via a display device 35. By constantly monitoring the transport speed and the flow amount of the recycled condensate by means of the flow amount sensor 32 and the test device 30, it is possible to carry out true regulation of the washing process, where the control circuit includes the test device 30. Not only the steam through-put, but also the length L of the "treatment stretch" and, if applicable (for embodiments pursuant to FIG. 2 and 3), the lengths of the offset stretches 54', 54", can be adjusted in such a way that optimum washing results can be achieved. An important point consists of the fact that the washing effect is brought about solely by the action of the steam, without applying additional chemicals.

Instead of measuring the residue concentration in the medium drawn off (or in addition to this), the concentration of the residues remaining on the width of fabric 1 after suction can also be determined in a residual chemical measurement device 36, which is arranged behind the suction device 20 in the transport direction 1' and indicated with dot-dash lines in FIG. 4. The measurement signal is passed to the central control and regulation unit 7 via the signal line 37, and used for regulation.

In orientation tests using an arrangement pursuant to FIG. 3, an open towel fabric made from 100% cotton was dyed blue with 25 g/liter Indathrene RS liquid blue. The test arrangement had the following parameters:

width 41 of the injection slit nozzle 40: 1 mm steam pressure: 0.5 bar width 51" of the suction slit nozzle 50": 4 mm suction pressure: 15 inches Hg (i.e. 0.5 bar partial vacuum)

distance between the slit nozzles 40 and 50" in the transport direction 1' from center to center: 4 cm distance 42 of the injection slit nozzle 40 from the top of the width of fabric 1: 1 cm With this test arrangement, the following comparison tests were conducted, with the results indicated in each instance:

| | |
|---|---|
| Only steam blown on to fabric | Removal effect slight |
| Steam at 0.5 bar above atmospheric blown on to fabric and water poured on to fabric | Removal effect slight |
| Small amount of steam blown on to fabric and fabric | Removal effect slight |

-continued

| | |
|---|---|
| suctioned off at 15 inches Hg (0.5 bar below atmospheric) | |
| Steam at 0.5 bar above atmospheric blown on to fabric and fabric suctioned off at 15 inches Hg (0.5 bar below atmospheric) | Removal effect significant, clear color removal exhibited, fabric almost white |

We claim:

1. A method for washing fabric, comprising the steps of:

transporting a web of fabric in a transport direction;

blowing steam at a pressure of at least 0.2 bar above atmospheric on a first side of the fabric, at a first location along a length of the fabric, to thereby excite to decomposition large organic molecules located on or in the fabric;

providing a partial vacuum of at least 0.2 bar below atmospheric on a second side of the fabric, the partial vacuum being provided in a vicinity of the first location, to thereby remove decomposed large organic molecules from the fabric after decomposition, the partial vacuum thereby removing a mixture of steam, liquid and residue from the fabric;

regulating the blowing of steam onto the fabric and removal of molecules from the fabric as a function of parameters of the fabric; and adjusting a position of the first location in the transport direction and a position of the second location in the transport direction.

2. A full-width washing machine for a steam-permeable fabric, comprising:

a steam generation device;

an injection device having an exit opening directed toward the fabric on one side of the fabric, the injection device extending over a width of the fabric, the injection device being connected to the steam generation device, the injection device injecting steam at a pressure of at least 0.2 bar above atmospheric into the width of the fabric;

a capture device with an entry opening directed toward the fabric on an opposite side of the fabric, the capture device extending over the width of the fabric, the capture device being located in a vicinity of the injection device, the capture device comprising a suction device touching the fabric, the capture device providing a partial vacuum of at least 0.2 bar below atmospheric to the width of the fabric;

a transport device for transporting the fabric in a transport direction and between the exit opening and the entry opening; and a control and regulation device connected to the injection device, the suction device and the steam generation device, the control and regulation device regulating the injection of steam into the fabric and removal of molecules from the fabric as a function of parameters of the fabric;

wherein a position of the exit opening in the transport direction and a position of the entry opening in the transport direction are adjustable; and whereby large organic molecules on the fabric are excited to decomposition by the steam, and whereby decomposed large organic molecules are removed from the fabric by the capture device.

3. The method of claim 1, wherein:

the partial vacuum is at least 0.5 bar below atmospheric.

4. The full-width washing machine of claim 2, wherein:

the partial vacuum is at least 0.5 bar below atmospheric.

5. The full-width washing machine of claim 2, wherein:

the exit opening and the entry opening are opposite one another and overlap one another.

6. The full-width washing machine of claim 2, wherein:

the entry opening is offset from the exit opening in the transport direction.

7. The full-width washing machine of claim 2, wherein:

a width of the exit opening in the transport direction and a width of the entry opening in the transport direction are equal.

8. The full-width washing machine of claim 2, wherein:

a width of the entry, opening in the transport direction is greater than a width of the exit opening in the transport direction.

9. The full-width washing machine of claim 2, wherein:

the exit opening and the entry opening are slits.

10. The full-width washing machine of claim 9, wherein:

the exit opening and the entry opening are delimited by slit nozzles.

11. The full-width washing machine of claim 10, wherein:

the slit nozzles are pressed against the fabric, and wherein the width of the fabric lies in-between the slit nozzles.

12. The full-width washing machine of claim 10, wherein:

the slit nozzle of the exit opening is spaced from the fabric.

13. The full-width washing machine of claim 2, wherein:

the control and regulation device is a microprocessor.

14. The full-width washing machine of claim 2, wherein:

the pressure of the injection device and the partial vacuum of the capture device are regulated by the control and regulation device as a function of parameters of the fabric.

15. The full-width washing machine of claim 2, further comprising:

setting devices operatively coupled to the exit opening and the entry opening, the setting devices adjusting the width of the exit opening in the transport direction and the width of the entry opening in the transport direction, the setting devices being controlled by the control anti regulation device.

16. The full-width washing machine of claim 2, wherein:

the control and regulation device controls the injection of steam and removal of organic molecules as a function of a transport speed of the fabric.

17. The full-width washing machine of claims 2, further comprising:

a test device through which an extracted washing medium from the capture is passed, the test device transmitting output signals to the control and regulation device, the output signals corresponding to a concentration of organic molecules in the extracted washing medium, the control and regulation device adjusting the injection of steam by the injection device and removal of organic molecules by the capture device as a function of the output signals of the test device.

18. The full-width washing machine of claim 2, further comprising:

a detection device to determine the concentration of organic molecules remaining on or in the fabric after the width of the fabric is transported between the exit opening and the entry opening, the detection device transmitting output signals to the control and regulation device, the output signals corresponding to a concentration of organic molecules in or on the fabric after the width of fabric is transported between the exit opening and the entry opening, the control and regulation device adjusting the injection of steam by the injection device and removal of organic molecules by the capture device as a function of the output signals of the detection device.

19. The full-width washing machine of claim 2, further comprising:

a device to provide a gas or a liquid into the injection device, in addition to the steam.

* * * * *

UNITED STATES PATENT AND TRADEMARK OFFICE

CERTIFICATE OF CORRECTION

PATENT No. : 5,493,744

DATED : Feb. 27, 1996

INVENTOR(S): Helmut Beckstein, Hans Bors and Bernhard Brendel

It is certified that error appears in the above-identified patent and that said Letters Patent is hereby corrected as shown below:

On the title page, and Column 1, lines 1-3;

-- [54] METHOD FOR WASHING A TEXTILE WIDTH OF FABRIC, AND FULL-WIDTH WASHING APPARATUS FOR PERFORMING THE METHOD--;

title page, Abstract, lines 7 and 8, delete "width of" ;

title page, Abstract, line 8, after "of" (second occurrence) insert --the--;

Column 2, line 6, after "0.2 bar" insert --, (i.e., 0.2 bar below atmospheric pressure)--;

UNITED STATES PATENT AND TRADEMARK OFFICE

CERTIFICATE OF CORRECTION

PATENT No. : 5,493,744

DATED : Feb. 27, 1996

INVENTOR(S): Helmut Beckstein, Hans Bors and Bernhard Brendel

It is certified that error appears in the above-identified patent and that said Letters Patent is hereby corrected as shown below:

Column 3, lines 25-26, should read --washed out of the width of fabric in the medium drawing off. This can be included in the control and regulation.--;

Column 4, line 28, "52" should be --52'--;

UNITED STATES PATENT AND TRADEMARK OFFICE

CERTIFICATE OF CORRECTION

PATENT No. : 5,493,744

DATED : Feb. 27, 1996

INVENTOR(S): Helmut Beckstein, Hans Bors and Bernhard Brendel

It is certified that error appears in the above-identified patent and that said Letters Patent is hereby corrected as shown below:

Column 4, line 36, "54" should be --54"--;

Column 7, line 8, before "We claim" insert --Obviously, what is important is that steam is applied at significant pressure and simultaneously drawn off at significant partial vacuum.--;

Column 8, line 42, "anti" should be --and--; and

Column 8, line 49, "claims" should be --claim--.

Signed and Sealed this

Twenty-fourth Day of August, 1999

*Attest:*

Q. TODD DICKINSON

*Attesting Officer*

*Acting Commissioner of Patents and Trademarks*